US005649595A

United States Patent [19]

Davis et al.

[11] Patent Number: 5,649,595

[45] Date of Patent: Jul. 22, 1997

[54] MILLING METHOD FOR LINERS EXTENDING INTO DEVIATED WELLBORES

[75] Inventors: John P. Davis, Cypress; Bruce A. Flanders; Mark W. Brockman, both of Houston, all of Tex.

[73] Assignee: Baker Hughes Incorporated, Houston, Tex.

[21] Appl. No.: 501,192

[22] Filed: Jul. 11, 1995

[51] Int. Cl.[6] ..... E21B 29/06; E21B 33/14

[52] U.S. Cl. ..... 166/297; 166/50; 166/55.6; 166/285; 166/384

[58] Field of Search ..... 166/50, 55.6, 117.6, 166/285, 297, 384

[56] References Cited

U.S. PATENT DOCUMENTS

| | | | |
|---|---|---|---|
| 5,289,876 | 3/1994 | Graham | 166/276 |
| 5,301,760 | 4/1994 | Graham | 175/61 |
| 5,322,127 | 6/1994 | McNair et al. | 166/50 X |
| 5,353,876 | 10/1994 | Curington et al. | 166/384 X |
| 5,477,925 | 12/1995 | Trahan et al. | 166/50 X |

*Primary Examiner*—George A. Suchfield
*Attorney, Agent, or Firm*—Rosenblatt & Redano

[57] ABSTRACT

An apparatus and method of milling a liner extending from a deviated wellbore into a main wellbore is disclosed. The liner is inserted through a window and cemented in place with the cement extending back into the main wellbore. Mechanisms are provided on the liner to keep it away from the main wellbore casing wall to facilitate the proper operation of the washover tool. A top end taper is provided to help the washover tool reorient over the tubular liner if milling requires more than one trip into the well. A diverter is insertable prior to installation of the liner to assist in getting the liner to extend through a window. Upon milling through the liner, the washover tool straddles the diverter and latches into it to facilitate not only the removal of the diverter but also the entrapment of any debris created by the milling operation. Suitable sealing is provided with the diverter to keep the cement away from the latching mechanism during the cementing operation.

20 Claims, 6 Drawing Sheets

MILLING METHOD FOR LINERS EXTENDING INTO DEVIATED WELLBORES

FIELD OF THE INVENTION

The field of this invention relates to the milling of tubulars extending through a main wellbore into a deviated wellbore after cementing in place.

BACKGROUND OF THE INVENTION

In the past, whipstocks have been used to create a window in a casing in a main wellbore for the initiation of a deviated wellbore which diverges from the original wellbore. After milling the window and drilling the deviated wellbore, a tubular is inserted through the window into the deviated wellbore. Prior completions have generally involved the absence of any cementing of the liner extending into the deviated wellbore or if cementing were done, it was terminated short of the window milled in the casing in the main wellbore. In those earlier techniques, since cement would not be allowed to come back from the deviated wellbore into the main wellbore, milling out the tubing from the main wellbore which extended into the deviated wellbore was not necessary if further production was required from the main wellbore. Completion techniques have evolved to the point where after milling the window and creating the deviated wellbore, the liner is placed through the window into the deviated wellbore and cemented. Thereafter, a milling operation is necessary to remove that portion of the liner in the main wellbore and to retrieve the whipstock, if it has not already been earlier retrieved.

FIGS. 1 and 2 indicate these procedures that had been previously required in view of the use of existing equipment, as just described. FIG. 1 illustrates a main wellbore 10 which has a deviated wellbore 12 already drilled through it. Inside of the main wellbore 10 is casing 14, which has already been milled through the use of a whipstock 16 and a milling tool (not shown). At the conclusion of the milling of the "window" 18 in the casing 14, a liner 20 is inserted into casing 14 and is diverted into window 18 into deviated wellbore 12, as shown in FIG. 1. In order to make the turn into deviated wellbore 12, the liner 20 winds up being wedged against one side of the casing 14, as shown in FIG. 1. Similarly, that same liner 20 in the deviated wellbore 12 also can become wedged against the uncased bore making up wellbore 12, as shown in FIG. 1.

After placement of the liner 20 into deviated wellbore 12, the deviated wellbore is cemented around the liner 20 up into the main wellbore 10. Thereafter, a milling tool 22 is employed to mill out the portion of the liner 20 that extends in wellbore 10. Thereafter, the whipstock 16 is removed. This procedure is illustrated in more detail in U.S. Pat. No. 5,301,760. FIG. 2 reflects the use of centralizers 24 in the deviated wellbore 12 to centralize the liner 20 therein. While the centralizers located in the deviated wellbore 12 help to centralize the liner 20, that portion of the liner 20 that extends into the wellbore 10 is still wedged firmly against the casing 14 within wellbore 10 due to the angular deflection of the liner 20.

There are many practical problems disclosed by the method in U.S. Pat. No. 5,301,760 that are not revealed in the patent. The biggest problem occurs when a milling tool such as 22 is employed to begin the milling operation. Typically, a "washover"-type milling tool is used which has cutting elements on the bottom and on the inside. This type of tool is called a washover tool because its purpose is to straddle the tubular object to be milled. This type of milling tool generally has no cutting elements on its exterior. Cutting elements on the exterior of the milling tool 22 would be undesirable since it would result in milling away of the wall of casing 14 in wellbore 10. The problem arises in the sense that with the liner 20 wedged up against the casing 14 in wellbore 10, the washover milling tool 22 cannot fully get around the upper end of the liner 20. Instead, as shown in FIG. 1, some milling goes on on the inboard side 26 of liner 20, while more complete milling takes place on the outboard side 28. The result of this uneven milling is that slivers are formed because segments of the inboard side 26 are not fully milled. Since segments of the inboard side are not fully milled, they retain additional structural strength which ultimately results in directing the milling tool 22 in a deviated path toward window 18. This is undesirable since continued milling with the milling tool 22 in a skewed or deviated position can result in unwanted milling of segment 30 of the casing 14, which is located below the window. FIG. 2 is intended to illustrate the formation of slivers and the skewing of the milling tool 22 when an attempt is made to use a washover tool over a liner 20 when the liner 20 is pressed rigidly against the casing 14. As a result of the milling process illustrated in FIG. 2, segment 32 while shown in the drawing is, in effect, fully milled away while only portions of segment 34 on the inboard side 26 is effectively milled due to the inability of the washover tool 22 to fully wash over the inboard side 26. Accordingly, as a result of the milling operation illustrated in the U.S. Pat. No. 5,301,760, slivers 36 are formed which subsequently must be fished out or further ground up before the whipstock 16 can be removed.

Accordingly, one of the several objectives of the method of the present invention is to facilitate the milling operation by providing mechanisms to keep the liner 20 away from the wall of the casing 14 to facilitate the washover milling operation. Additionally, it is a further object of the invention to facilitate the insertion of the liner through the use of a diverter. It is another object to employ a diverter of suitable dimensions to allow the washover mill to straddle it and ultimately latch into it so that any segments of cement or similar material or metal slivers which may be formed are caught within the washover tool when it is latched to the diverter. Ultimately, it is another object of the invention to be able to remove the diverter and thus provide a clear access to a packer which is further downhole in the main wellbore.

SUMMARY OF THE INVENTION

An apparatus and method of milling a liner extending from a deviated wellbore into a main wellbore is disclosed. The liner is inserted through a window and cemented in place with the cement extending back into the main wellbore. Mechanisms are provided on the liner to keep it away from the main wellbore casing wall to facilitate the proper operation of the washover tool. A top end taper is provided to help the washover tool reorient over the tubular liner if milling requires more than one trip into the well. A diverter is insertable prior to installation of the liner to assist in getting the liner to extend through a window. Upon milling through the liner, the washover tool straddles the diverter and latches into it to facilitate not only the removal of the diverter but also the entrapment of any debris created by the milling operation. Suitable sealing is provided with the diverter to keep the cement away from the latching mechanism during the cementing operation.

DETAILED DESCRIPTION OF THE PREFERRED EMBODIMENT

Figure 3:
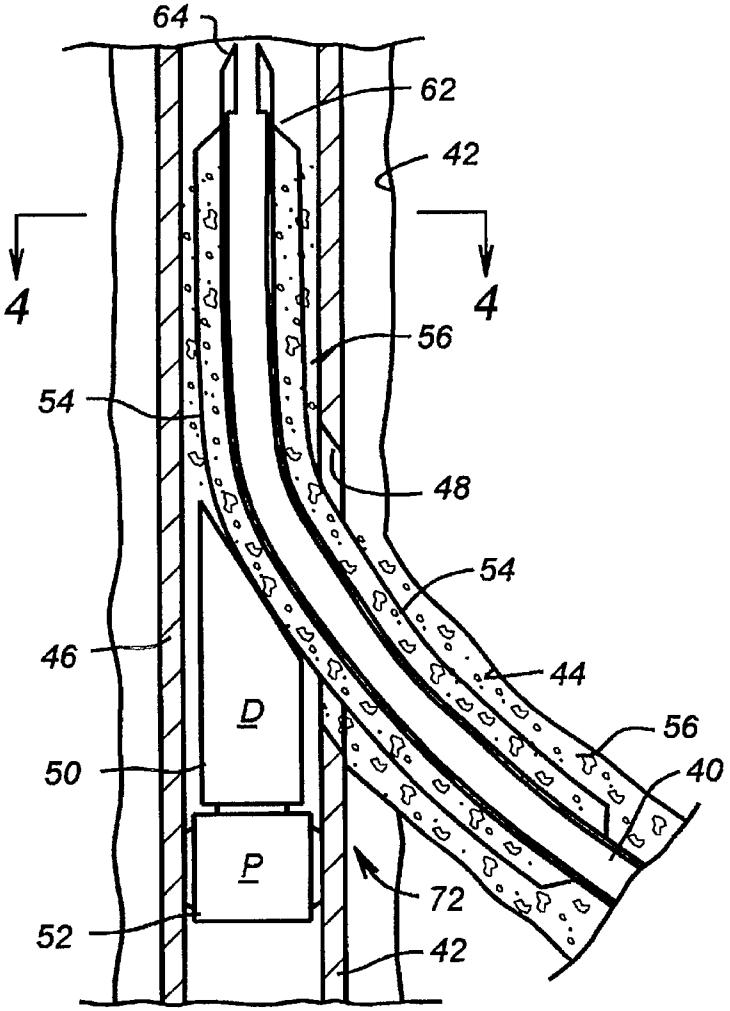
FIG. 3 illustrates schematically the apparatus and method of the present invention, showing the liner with a mechanism to keep it away from the casing wall.
Figure 6:
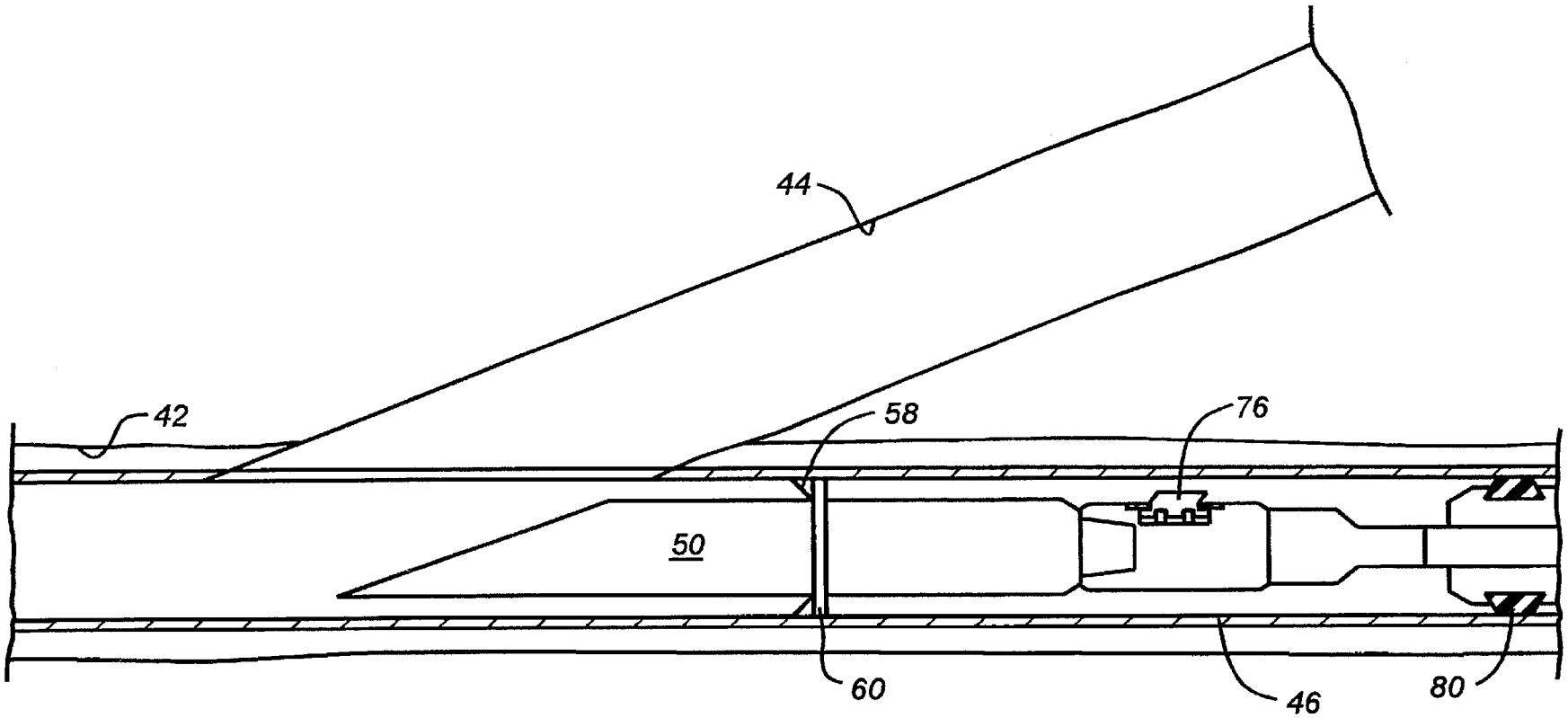
FIG. 6 is a detailed sectional drawing showing the diverter in position supported by a wellbore packer prior to insertion of the liner.
Figure 7:
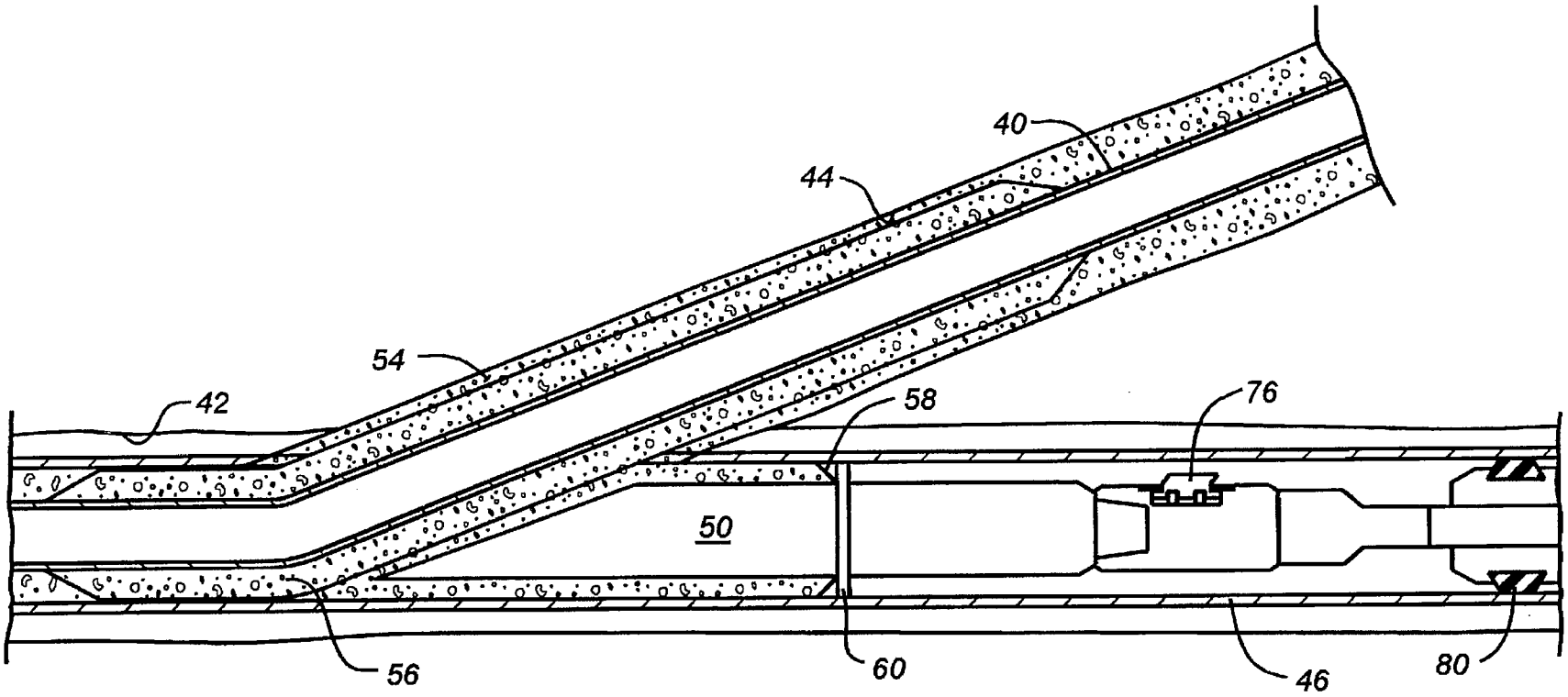
FIG. 7 is the view of FIG. 6, showing the liner inserted and fully cemented.

FIG. 3 schematically indicates the tubular liner 40, extending from the main wellbore 42 into the deviated wellbore 44. The main wellbore 42 has a casing 46 into which a window 48 has already been milled. A diverter 50, and generally indicated in the drawing as D, is located in the main wellbore 42 and supported by a packer 52, also referred to as P in the drawing of FIG. 3. The diverter 50 is inserted into the main wellbore 42 after removal of the whipstock at the conclusion of the milling of the window 48 in a manner well-known in the art. The diverter 50 is used in the position shown in FIG. 6 to deflect the liner 40 as it is inserted in the main wellbore 42 to orient its leading edge into the deviated wellbore 44, as shown in FIGS. 6 and 7.

One of the features of the present invention is the use of exterior spacers, such as ribs 54. As shown in the cross-section of FIG. 4, one embodiment is the use of longitudinal ribs disposed at 90° intervals continuously or discontinuously on the outer periphery of the liner 40 such that they extend into the main wellbore 42, thus keeping the liner 40 away from the casing 46, as shown in FIG. 3. Ribs 54 may be also circumferentially extending in the main wellbore 42 and can be of a construction shown in item 24 of FIG. 2. The ribs need not be continuous and can be at different spacing than 90°. Any type of spacer located so as to keep the upper segment of liner 40 away from the casing 46, as shown in FIG. 3, is within the scope of the invention. The liner 40 is encased in a sealer such as a cementitious material 56. Material 56 fills the voids around any spacer, such as ribs 54. The cementitious material extends into the main wellbore 42. As shown in FIG. 7, the cementitious material 56 is placed in the main and deviated wellbores 42 and 46, respectively, with the diverter 50 in position. Diverter 50 has a seal or seals 58 which retain the cementitious material 56 above a centralizer 60. The outside diameter of the diverter 50 is smaller than the diameter of the casing 46 within the mail wellbore 42.

Figure 4:
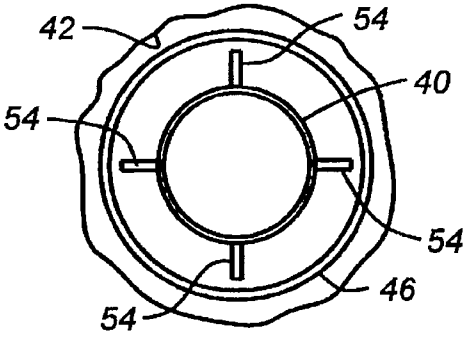
FIG. 4 is a sectional view along lines 4—4 of FIG. 3, showing a longitudinal rib structure as the technique for distancing the liner from the casing wall.
Figure 5:
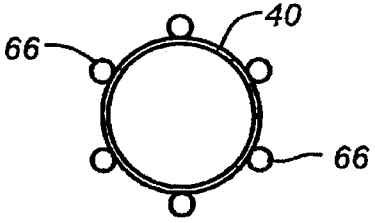
FIG. 5 is an alternative embodiment to FIG. 4, showing a plurality of protrusions added to the exterior surface of the liner as a way of keeping the liner from the casing wall in the main wellbore.

Referring now to FIG. 5, an alternative embodiment to the ribbed structure illustrated in FIG. 4 is shown. In FIG. 5, a series of protrusions which can be orderly or randomly arranged are placed on the outer periphery of the liner 40, particularly in the zone extending into the main wellbore 42 to, again, keep the upper end 62 away from the casing 46. A known running tool (not shown) can be used to facilitate the lowering and insertion of the liner 40 into the position shown in FIG. 3. Such a known running tool can leave a segment behind after release from the liner 40 which includes a taper 64. The significance of this taper 64 at the upper end 62 of the liner 40 will be explained below. It should be noted that it is within the purview of the invention to use a wide variety of spacing mechanisms on the outer periphery of the liner 40 in the portion that extends into the main wellbore 42 to keep that portion away from the casing 46. Thus, many types of mechanisms can be employed as a spacing mechanism to accomplish the objective without departing from the spirit of the invention; for example, apart from the longitudinal ribs and random or orderly protrusions, other devices can be used such as a helix, discrete rods, spaced transverse rings, as long as the objective of keeping the upper end 62 away from the rigid contact with casing 46 is accomplished. Whatever mechanism is employed, it should not interfere with the free flow of the cementitious material 56 which must be placed around the outer periphery of the liner 40 in the deviated wellbore 44 and on up to the upper end 62 of the liner 40, disposed within the main wellbore 42.

Figure 2:
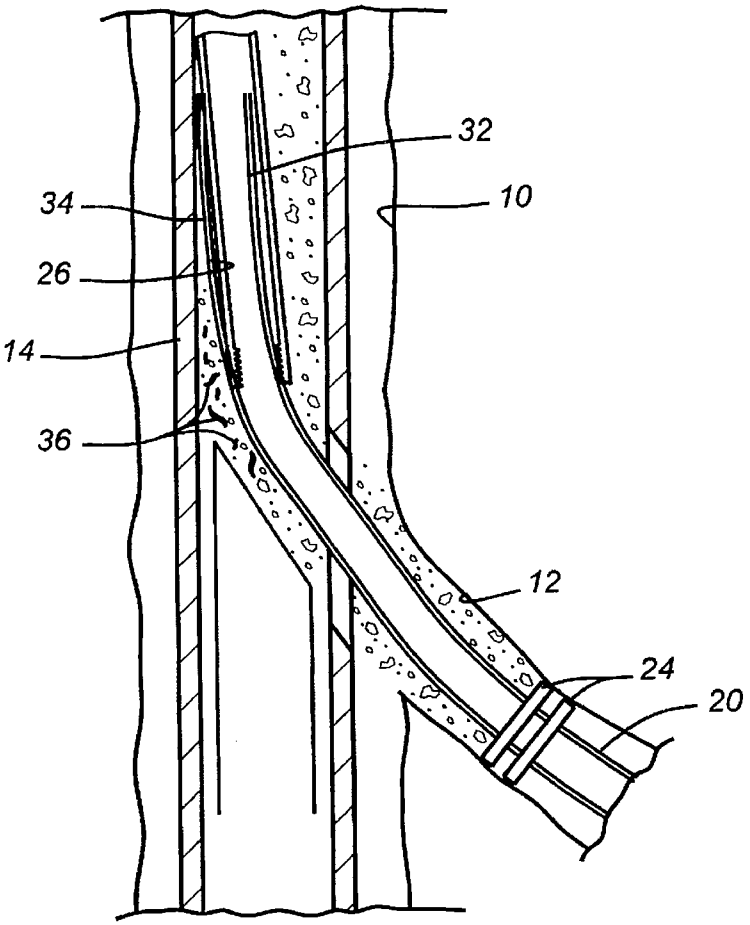
(PRIOR ART) FIG. 2
FIG. 2 illustrates the same thing as FIG. 1 except centralizers are shown in the deviated wellbore and the result of a milling operation with a washover mill leaving slivers is illustrated.
Figure 1:
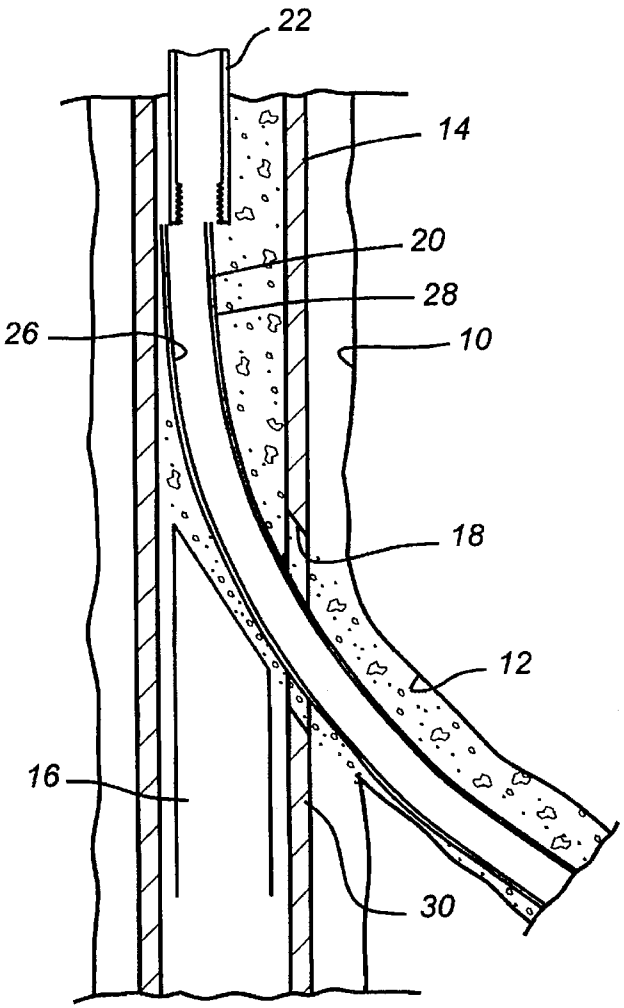
(PRIOR ART) FIG. 1
FIG. 1 illustrates a milling technique for a liner as shown and described in U.S. Pat. No. 5,301,760 without the use of a centralizer in the deviated wellbore.
Figure 8:
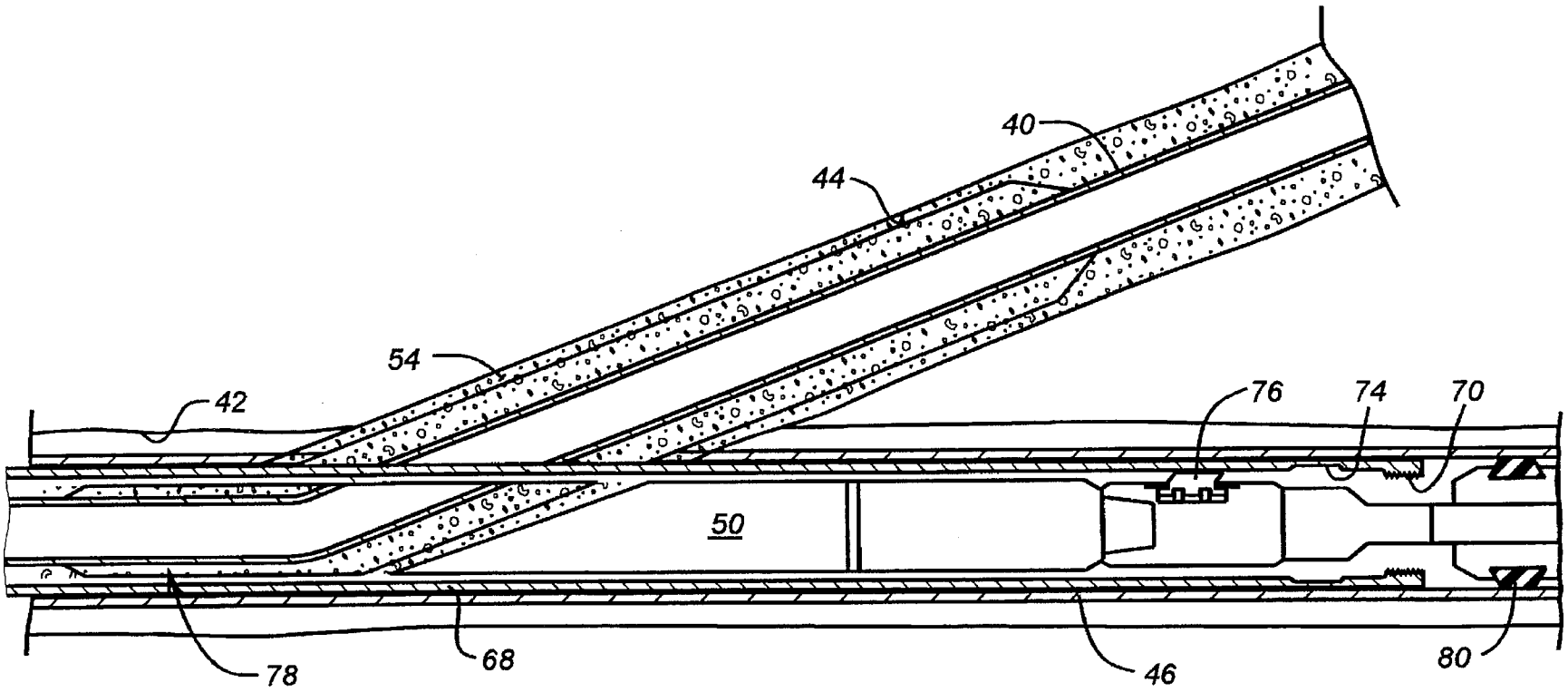
FIG. 8 is the view of FIG. 7, after the washover pipe has cut through the liner portion extending into the main wellbore and has passed by the latching mechanism of the diverter.

By employment of the spacing mechanism such as ribs 54 or other protrusions 66, illustrated in FIG. 5, the washover tool 68 (see FIG. 8) can easily straddle the liner as it properly needs to do so that cutting can be accomplished with minimal creation of slivers which had occurred employing the washover tool in the methods revealed in U.S. Pat. No. 5,301,760, as illustrated in FIGS. 1 and 2. By moving the upper end 62 away from the wall, the internal cutters 70 (see FIG. 8) can evenly cut away the protrusion and then that portion of the liner 40 within the main wellbore 42. Since the washover tool 68 is not eccentrically disposed with respect to the liner 40 adjacent the upper end 62 as was the case in FIGS. 1 and 2, slivers are not a problem. In effect, the washover tool 68 cleanly mills away the ribs, such as 54. Eventually, the washover tool 68 begins to cut through the wall of the liner 40. However, by then it has cleanly encircled the upper end 62 of liner 40 and can then make meaningful progress in a direction straight ahead toward a position where the diverter 50 is fully straddled, as shown in FIG. 8. Since the upper end 62 serves as a guide for the washover tool 68 because milling is cleanly going on around the periphery of the upper end 62, the tendency of the liner 40 to misdirect the washover tool 68 toward window 48, which was present in the milling techniques illustrated in FIGS. 1 and 2, is removed. Even if the washover tool 68 must be replaced prior to the conclusion of the entire milling operation, the same results can be obtained without risk of inadvertent milling of any portion of the casing 46 in the region 72 below the window 48. What occurs if the washover tool 68 must be removed before the conclusion of the milling is that the spacing mechanism, such as ribs 54 or protrusions 66, have been milled from a portion of the upper end 62. Upon initial removal of the washover tool 68 before the conclusion of the milling operation, the upper end 62 of the liner 40 will flex toward the casing 46 in the main wellbore 42. However, because of the taper 64 which has been deposited at the upper end 62 when the release has occurred from the running tool (not shown), the newly inserted washover tool 68 can readily get behind the upper end 62 of the liner 40 to once again resume the milling operation with the upper end 62 fully enclosed within the washover tool 68 as the milling continues. Again, the presence of the liner 40 acts as a guide to keep the initial progress of the washover tool 68 oriented in the direction of main wellbore 42 until actual cutting through the liner wall is accomplished, as shown in FIG. 8. Thereafter, the washover tool 68 progresses to the point where an internal recess 74 passes over and beyond a latch mechanism such as spring-loaded dogs 76. As shown in FIG. 8, the trimmed section of liner 78 is effectively trapped within the washover tool 68 above the diverter 50. A comparison of FIGS. 7 and 8 reveals that the use of the washover tool 68 has resulted in the milling away of the seal 58 as well as the centralizer 60. Although only the liner section 78 is shown to be within the washover tool 68 in FIG. 8, those skilled in the art can appreciate that other metal fragments or portions of the cementitious material 56 can also be disposed within the washover tool 68 above the diverter 50. For example, the ribs 54 (see FIG. 4) or protrusions 66 (see FIG. 5) are also milled by the cutters 70 and captured within the body of the washover tool 68.

Figure 9:
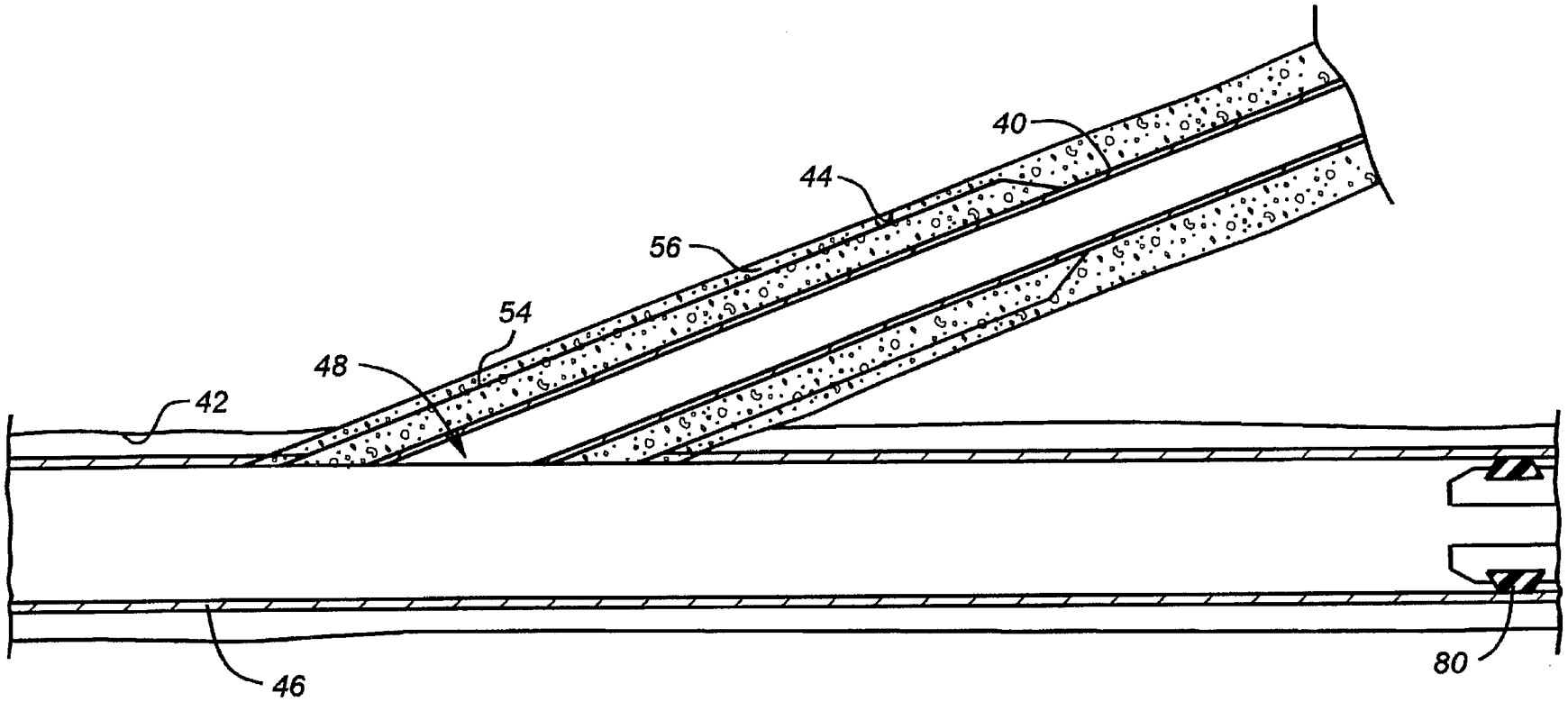
FIG. 9 is a view after the washover tool effectively removes the diverter from the packer in the main wellbore.

At the conclusion of the milling operation, the washover tool 68 is pulled up, bringing up recess 74 until dogs 76 come into alignment with recess 74, thereby facilitating the release of the diverter tool 50 from the packer 80 (see FIGS. 8 and 9). What remains is a deviated wellbore 44 that is lined with a cementitious material or equivalent 56 disposed around the cut-off liner 40 which terminates at window 48. In the main wellbore 42, the casing 46 has a clear path down to packer 80. This facilitates subsequent operations in the main wellbore 42 below packer 80, if necessary, or removal of packer 80. Simultaneously, production can proceed from the deviated wellbore 44. This process can be repeated many times to create multiple deviated wellbores, such as 44, using the equipment above described.

Those skilled in the art can appreciate that the method as above described offers unique advantages over prior techniques. Since the liner is held, at least initially, away from the wall of the casing 46 at the onset of milling with the washover tool 68, proper operation of the washover tool 68 minimizes the formation of slivers of the liner 40 during the milling operation. Also, the tendency of the liner 40 to pull the washover tool 68 laterally toward the window 48, due to the uneven milling which occurred with the prior designs, is eliminated. Instead, the washover tool 68 proceeds to initially grind the cementitious material 56, as well as any projections or protrusions, such as 54 or 66, and ultimately slices cleanly through the liner 40 as it approaches the area of window 48. Other types of mills may be used without departing from the spirit of the invention.

The diverter 50 is installed after removal of the whipstock. Generally, to withstand the forces applied during the milling of the window 48, the whipstock (not shown) must be full-size or close thereto. The diverter 50, which does not need to withstand loads comparable to those delivered during the milling of a window 48, can be substantially smaller than a whipstock. The function of the diverter is to direct the liner 40 into the window 48 on initial insertion. This minimizes the need to twist or turn the liner 40 to get it to advance into the window 48. Twisting or turning the liner 40 can be disadvantageous, particularly if the spacing devices, such as ribs 54 or protrusions 66, are used. The possibility can exist for sticking the liner 40 in an attempt to guide it into the lateral wellbore 44. Accordingly, the use of the diverter 50, which is sufficiently undersized when compared to the inside diameter of the casing 46 in the main wellbore 42, accomplishes not only the objective of easily guiding the liner 40 into the window 48, but also presents a profile for the diverter 50 which will allow the washover tool 68 to advance over it, as shown in FIG. 8, for ultimate capture of the milling byproducts and the removal of such byproducts in conjunction with the removal of the diverter 50 from the wellbore. The packer 80 can remain in the wellbore for further future downhole operations. Additionally, even if multiple trips with one or more washover tools 68 become necessary and the upper end 62 flexes back toward the casing 46 because some of the ribs 54 or protrusions 66 have been milled away, on a second or subsequent trip, the washover tool 68 can easily seek the taper 64 and move the upper end 62 away from the wall so that milling can then resume with the washover tool 68 comfortably straddling the upper end 62 of the liner 40.

The foregoing disclosure and description of the invention are illustrative and explanatory thereof, and various changes in the size, shape and materials, as well as in the details of the illustrated construction, may be made without departing from the spirit of the invention.

We claim:

1. A method of milling a tubular extending from a main wellbore into a deviated wellbore, comprising:

inserting the tubular into a cased main wellbore;

advancing the tubular through a window in the casing and into a deviated wellbore;

providing a spacing device on the outer periphery of said tubular in a location so as to keep at least an upper segment of said tubular disposed in said main wellbore away from direct contact with said casing;

milling off the portion of said tubular extending into said main wellbore.

2. The method of claim 1, further comprising:

using at least one protrusion on the outer periphery of said tubular as said spacing device.

3. The method of claim 1, further comprising:

using at least one circumferentially extending rib on the outer periphery of said tubular as said spacing device.

4. The method of claim 1, further comprising:

inserting a diverting tool into the main wellbore prior to insertion of said tubular through said window;

using said diverting tool to direct said tubular into said window.

5. The method of claim 4, further comprising:

providing an annular clearance between said diverting tool and said casing;

straddling over an upper end of said tubular with a milling tool;

advancing said milling tool over said diverter by moving it into said annulus.

6. The method of claim 1, further comprising:

providing a tapered upper end on said tubular.

7. The method of claim 6, further comprising:

starting to mill said spacing device prior to cutting into said tubular;

removing said milling tool prior to milling off the portion of said tubular extending into said main wellbore;

allowing said tubular adjacent its upper end to flex into contact with said casing in said main wellbore as a result of said removal of said milling tool;

reinserting a milling tool into said main wellbore;

moving the upper end of said tubular away from said casing by contact of said milling tool with said tapered upper end;

advancing said milling tool over said tubular to conclude the milling.

8. The method of claim 4, further comprising:

using said milling tool to retrieve said diverting tool at the conclusion of milling.

9. The method of claim 2, further comprising:

inserting a diverting tool into the main wellbore prior to insertion of said tubular through said window;

using said diverting tool to direct said tubular into said window.

10. A method of milling a tubular extending from a main wellbore into a deviated wellbore, comprising:

inserting the tubular into a cased main wellbore;

advancing the tubular through a window in the casing and into a deviated wellbore;

providing a spacing device on the outer periphery of said tubular in a location so as to keep at least an upper segment of said tubular disposed in said main wellbore away from direct contact with said casing;

milling off the portion of said tubular extending into said main wellbore;

using at least one longitudinally extending rib on the outer periphery of said tubular as said spacing device.

11. A method of milling a tubular extending from a main wellbore into a deviated wellbore, comprising:

inserting the tubular into a cased main wellbore;

advancing the tubular through a window in the casing and into a deviated wellbore;

providing a spacing device on the outer periphery of said tubular in a location so as to keep at least an upper segment of said tubular disposed in said main wellbore away from direct contact with said casing;

milling off the portion of said tubular extending into said main wellbore;

inserting a diverting tool into the main wellbore prior to insertion of said tubular through said window;

using said diverting tool to direct said tubular into said window;

providing an annular clearance between said diverting tool and said casing;

straddling over an upper end of said tubular with a milling tool;

advancing said milling tool over said diverter by moving it into said annulus;

catching debris from use of said milling tool within said milling tool;

latching said milling tool to said diverter tool upon sufficient movement of said milling tool within said annulus.

12. The method of claim 11, further comprising:

trapping said debris within said milling tool by said latching;

removing said diverter with said milling tool and trapped debris from the main wellbore.

13. The method of claim 12, further comprising:

providing a seal on said diverting tool in said annulus;

providing a sealing material around said tubular in said main and deviated wellbores as well as into said annulus up to said seal;

using said milling tool to mill away said sealing material in said main wellbore and said seal in said annulus.

14. The method of claim 13, further comprising:

providing a centralizer in said annulus adjacent said seal;

milling away said centralizer with said milling tool prior to latching said milling tool to said diverting tool.

15. The method of claim 11, further comprising:

providing an internal groove in said milling tool;

providing biased latching dogs on said diverting tool;

positioning said groove to allow said dogs to advance into said groove.

16. A method of milling a tubular extending from a main wellbore into a deviated wellbore, comprising:

inserting the tubular into a cased main wellbore;

advancing the tubular through a window in the casing and into a deviated wellbore;

providing a spacing device on the outer periphery of said tubular in a location so as to keep at least an upper segment of said tubular disposed in said main wellbore away from direct contact with said casing;

milling off the portion of said tubular extending into said main wellbore;

using at least one protrusion on the outer periphery of said tubular as said spacing device;

inserting a diverting tool into the main wellbore prior to insertion of said tubular through said window;

using said diverting tool to direct said tubular into said window;

using said milling tool to retrieve said diverting tool at the conclusion of milling.

17. The method of claim 16, further comprising:

catching debris from use of said milling tool within said milling tool;

latching said milling tool to said diverter tool upon sufficient movement of said milling tool.

18. The method of claim 17, further comprising:

trapping said debris within said milling tool by said latching;

removing said diverter with said milling tool and trapped debris from the main wellbore.

19. The method of claim 18, further comprising:

providing a tapered upper end on said tubular.

20. The method of claim 19, further comprising:

starting to mill said spacing device prior to cutting into said tubular;

removing said milling tool prior to milling off the portion of said tubular extending into said main wellbore;

allowing said tubular adjacent its upper end to flex into contact with said casing in said main wellbore as a result of said removal of said milling tool;

reinserting a milling tool into said main wellbore;

moving the upper end of said tubular away from said casing by contact of said milling tool with said tapered upper end;

advancing said milling tool over said tubular to conclude the milling.

* * * * *